US005708904A

United States Patent [19]

Frank et al.

[11] Patent Number: 5,708,904

[45] Date of Patent: Jan. 13, 1998

[54] PHOTOGRAPHIC EMULSION SURFACE REFORMING METHOD

[75] Inventors: Lee F. Frank; Robert John Baron; Robert Michael Train, all of Rochester, N.Y.

[73] Assignee: Eastman Kodak Company, Rochester, N.Y.

[21] Appl. No.: 665,126

[22] Filed: Jun. 14, 1996

[51] Int. Cl.[6] ..... G03D 7/00

[52] U.S. Cl. ..... 396/574; 396/604; 396/626

[58] Field of Search ..... 396/604, 571, 396/574, 576, 626, 627; 430/401, 30; 118/50, 65, 68, 325, 446, 267; 34/557, 535, 452; 164/167, 83, 341

[56] References Cited

U.S. PATENT DOCUMENTS

| | | | |
|---|---|---|---|
| 2,951,007 | 8/1960 | Lippke | 162/198 |
| 3,470,625 | 10/1969 | Chikamasa et al. | 34/23 |
| 3,599,554 | 8/1971 | Aelterman | 396/571 |
| 3,720,150 | 3/1973 | Hurtig et al. | 95/94 |
| 3,805,402 | 4/1974 | Aono et al. | 34/23 |
| 3,838,000 | 9/1974 | Urbas | 162/207 |
| 4,088,728 | 5/1978 | Godfrey | 264/167 |
| 4,168,579 | 9/1979 | Ericsson | 34/46 |
| 4,188,731 | 2/1980 | Rauskolb | 34/41 |
| 4,207,143 | 6/1980 | Glomb et al. | 162/207 |
| 4,247,990 | 2/1981 | Ohls et al. | 34/23 |
| 4,378,639 | 4/1983 | Walker | 34/12 |
| 4,529,563 | 7/1985 | McGinniss | 264/83 |
| 4,733,078 | 3/1988 | Sturm | 250/339 |
| 4,842,982 | 6/1989 | Seibel et al. | 430/156 |
| 4,844,842 | 7/1989 | Markl et al. | 261/30 |
| 4,868,098 | 9/1989 | Steiger et al. | 430/393 |
| 4,872,270 | 10/1989 | Fronheiser et al. | 34/23 |
| 4,920,202 | 4/1990 | Irie et al. | 528/500 |
| 4,925,767 | 5/1990 | Daems et al. | 430/258 |
| 4,952,960 | 8/1990 | Kosugi et al. | 354/299 |
| 5,061,611 | 10/1991 | Sakata et al. | 430/533 |
| 5,068,681 | 11/1991 | Kosugi et al. | 354/299 |
| 5,323,546 | 6/1994 | Glover et al. | 34/267 |
| 5,329,331 | 7/1994 | Hatori et al. | 354/299 |
| 5,404,656 | 4/1995 | Matsuda et al. | 34/446 |

*Primary Examiner*—D. Rutledge
*Attorney, Agent, or Firm*—Peyton C. Watkins

[57] ABSTRACT

A method for reforming the surface of a photographic emulsion layer. In the method, the surface of the emulsion layer is dried to at least sensible dryness. Water is then deposited onto the surface of the emulsion layer. The depositing is substantially uniform and in an amount that is less than about 0.80 grams of water per square foot of emulsion layer.

12 Claims, 6 Drawing Sheets

PHOTOGRAPHIC EMULSION SURFACE REFORMING METHOD

FIELD OF THE INVENTION

The invention relates to photographic emulsions and to deposition methods and equipment for depositing small mounts of materials and more particularly relates to a photographic emulsion surface reforming method.

BACKGROUND OF THE INVENTION

In the preparation and processing of film materials, such as photographic film and photographic paper, it is sometimes desirable to slightly wet the surface of the fill, to modify an exisiting characteristic or aid in the creation of a new characteristic. The water is commonly supplied by a variety of means such as: dipping followed by squeegeeing or the like; blotting with a wet support; spraying, including ink jet spraying; rolling; "pulltruding" (low pressure die coating); or passing the film through humid air or steam and condensing water on the fill. Many of these processes have the shortcoming of tending to be uneven in coverage. Wetting agents are commonly used to help overcome initial distribution inhomogeneities. The following references illustrate specific processes.

U.S. Pat. No. 3,470,625 discloses a process in which photographic paper is dried excessively, then a mixture of steam and air or inert gas are blown at one side of paper to humidify to an excess humidity, following which air at a desired paper humidity is blown at the other side of the paper.

U.S. Pat. No. 4,247,990 discloses a process for providing a uniform moisture content in a paper web by contact with a gas at a desired equilibrium moisture level.

U.S. Pat. No. 4,925,767 discloses a process for controlling the gloss of a hydrophilic colloid image by use of a wetted support.

U.S. Pat. No. 4,207,143 discloses a process for adding moisture to a web by emitting dry steam vapor from steam-foil nozzles and condensing vapor onto the web.

U.S. Pat. No. 3,838,000 discloses a process and apparatus in which humidified air is pulled through a web by suction. The humidified air is prepared by mixing air streams having different humidities. The patent states:

"The individual temperatures, relative humidities and action of the air streams may be varied to control the supply of moisture to the web 30. The system employs controlled precipitation of the moisture by adding two psychrometrically prepared air streams to effect precise availability of water mist in the air. As an example of the air streams that may be used, FIG. 3 shows two air streams of sufficiently different humidity to generate a mist. Three mixing fines are shown where 70° F. saturated air is mixed with 174°, 165° and 160° saturated air. The saturated conditions are merely used as examples and, in actual practice, unsaturated air should be used to minimize dripping on the header surface prior to mixing." (col. 3, lines 59–71)

U.S. Pat No. 3,720,150 discloses an apparatus in which diazo film is fed in through a slot, subjected to a recycled water vapor-air mixture to condense water onto the film and is simultaneously exposed to ammonia vapor, and then heated and fed out through a slot. The apparatus moves the air with a blower and includes a chamber containing a water reservoir.

It would thus be desirable to provide an improved method for reforming the surface of a photographic emulsion using a very small amount of water.

SUMMARY OF THE INVENTION

The invention is defined by the claims. The invention, in its broader aspects, provides an improved method for reforming the surface of a photographic emulsion layer. In the method, the surface of the emulsion layer is dried to at least sensible dryness. Water is then deposited onto the surface of the emulsion layer. The depositing is substantially uniform and in an amount that is less than about 0.80 grams of water per square foot of emulsion layer.

It is an advantageous effect of at least some of the embodiments of the invention that an improved method is provided for reforming the surface of a photographic emulsion using a very small amount of water.

BRIEF DESCRIPTION OF THE FIGURES

The above-mentioned and other features and objects of this invention and the manner of attaining them will become more apparent and the invention itself will be better understood by reference to the following description of an embodiment of the invention taken in conjunction with the accompanying figures wherein.

DESCRIPTION OF PARTICULAR EMBODIMENTS

In the improved deposition method, a very small quantity of vaporizable material is deposited on a substrate on a substantially uniform basis.

Figure 1:
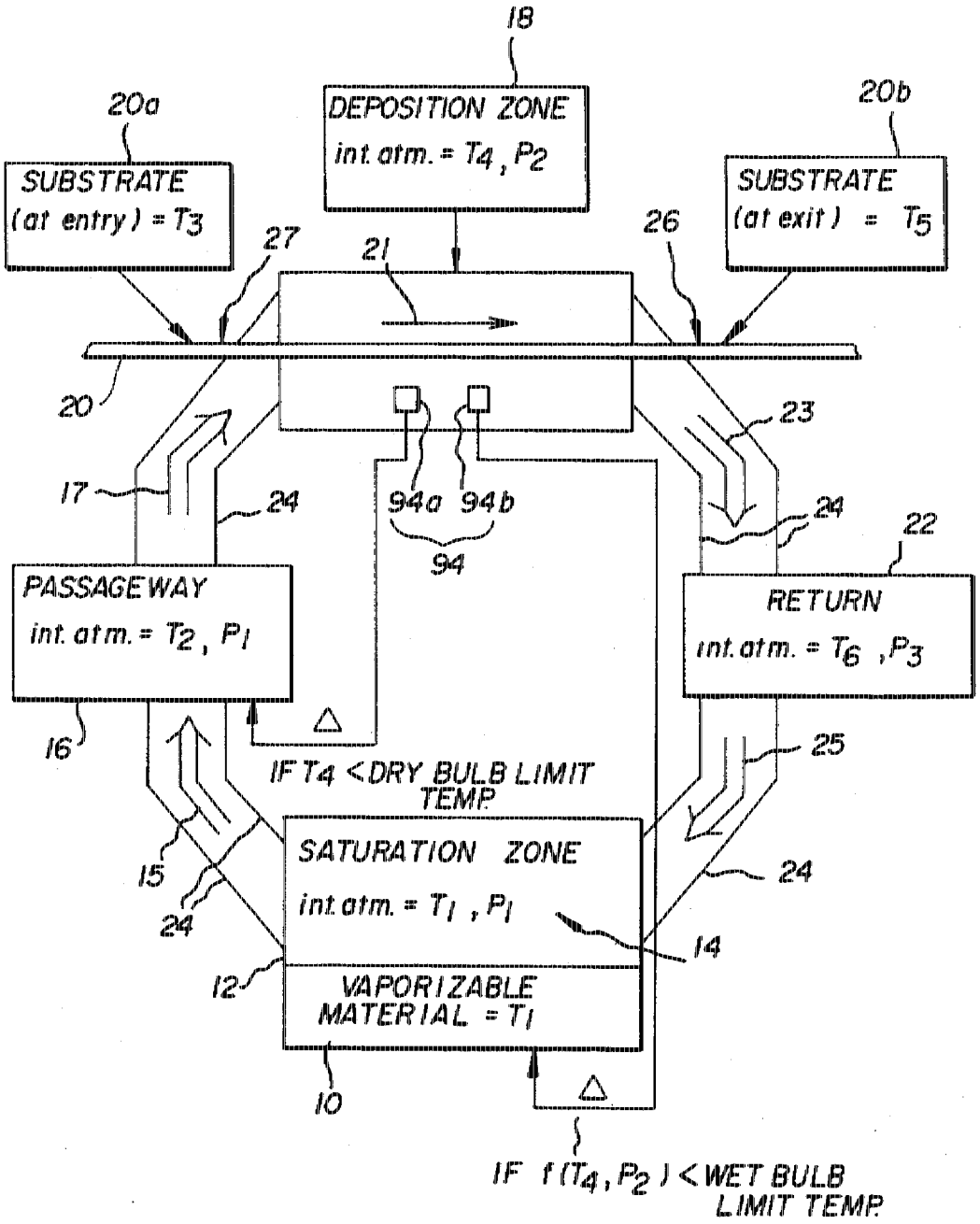
FIG. 1 is a diagrammatical view of an embodiment of the improved deposition method. End caps are deleted from the upper body for clarity.
Figure 2:
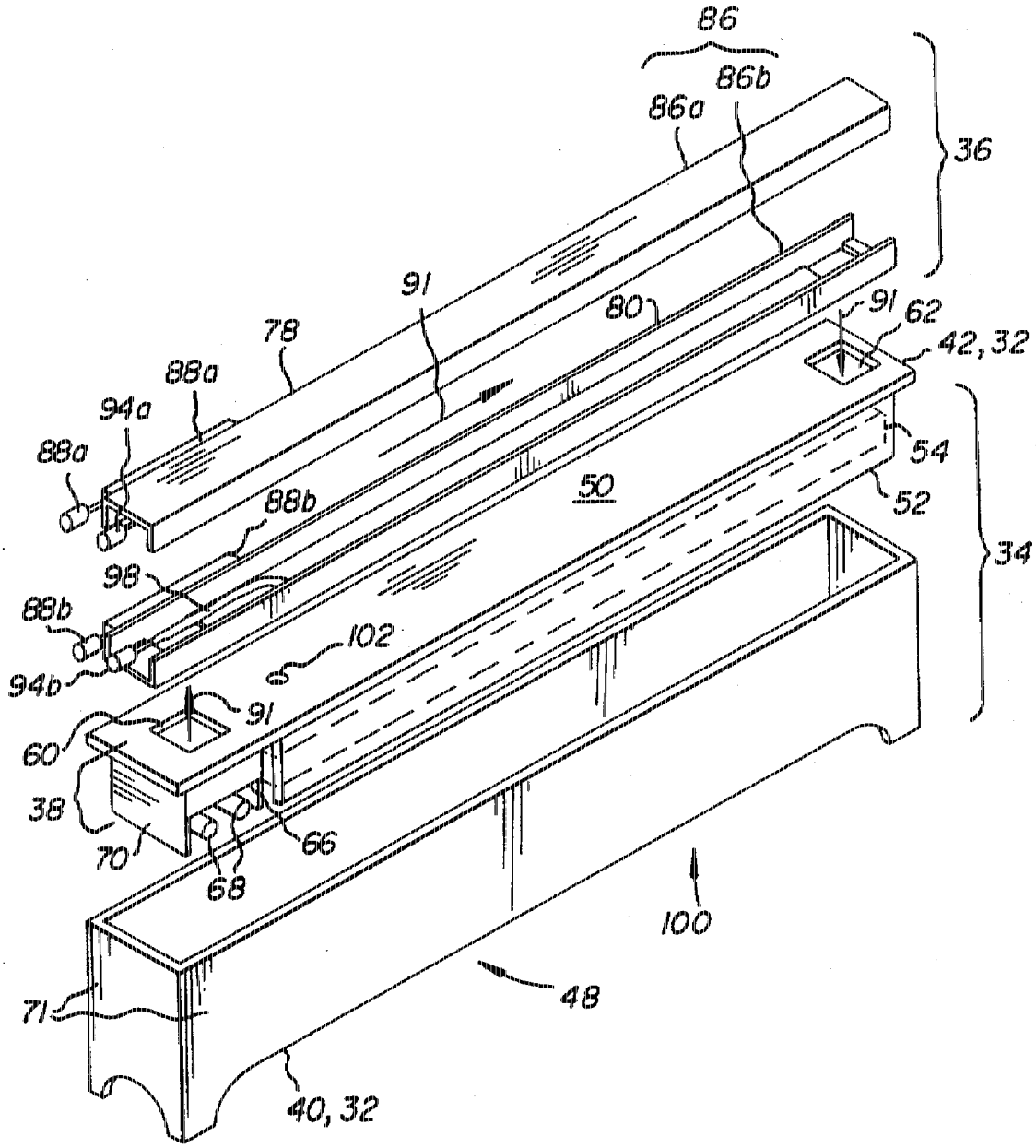
FIG. 2 is an exploded perspective view of the improved deposition apparatus.
Figure 3:
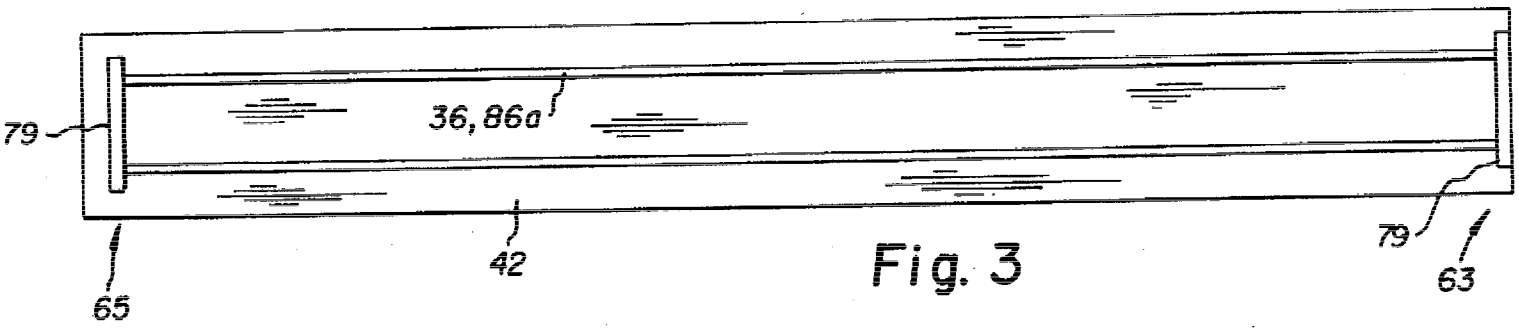
FIG. 3 is a top plan view of the upper and intermediate members of another embodiment of the apparatus of FIG. 2. Outlying structures are deleted for clarity.
Figure 4:
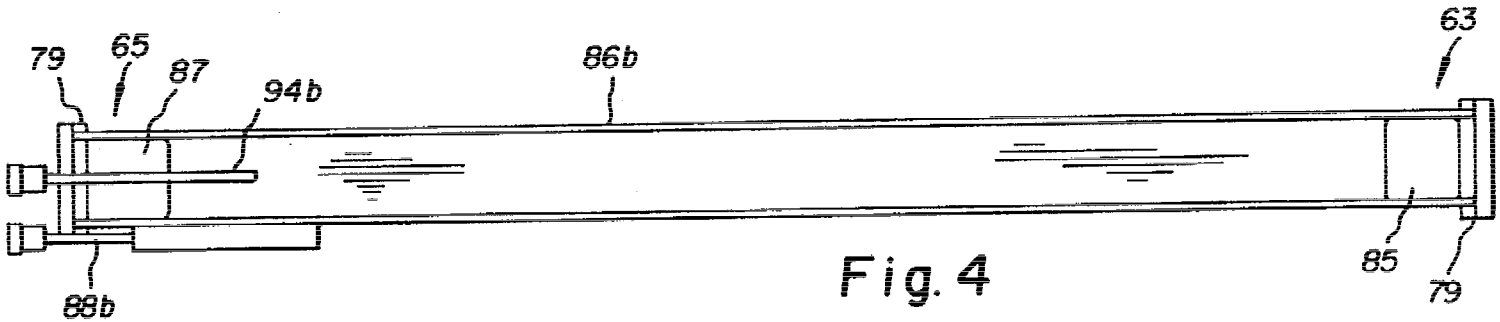
FIG. 4 is a top plan view of the first upper body subunit of the apparatus of FIG. 3.
Figure 5:
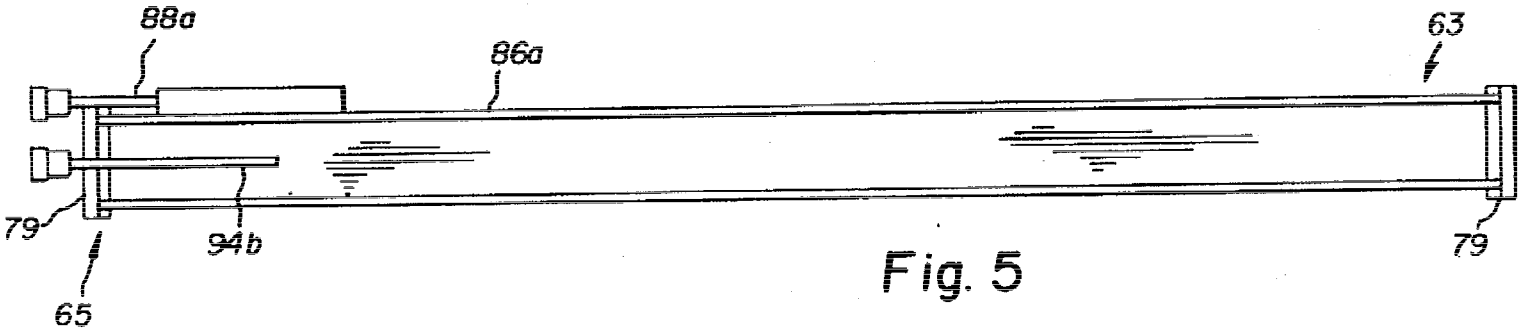
FIG. 5 is a bottom plan view of the second upper body subunit of the apparatus of FIG. 3.
Figure 6:
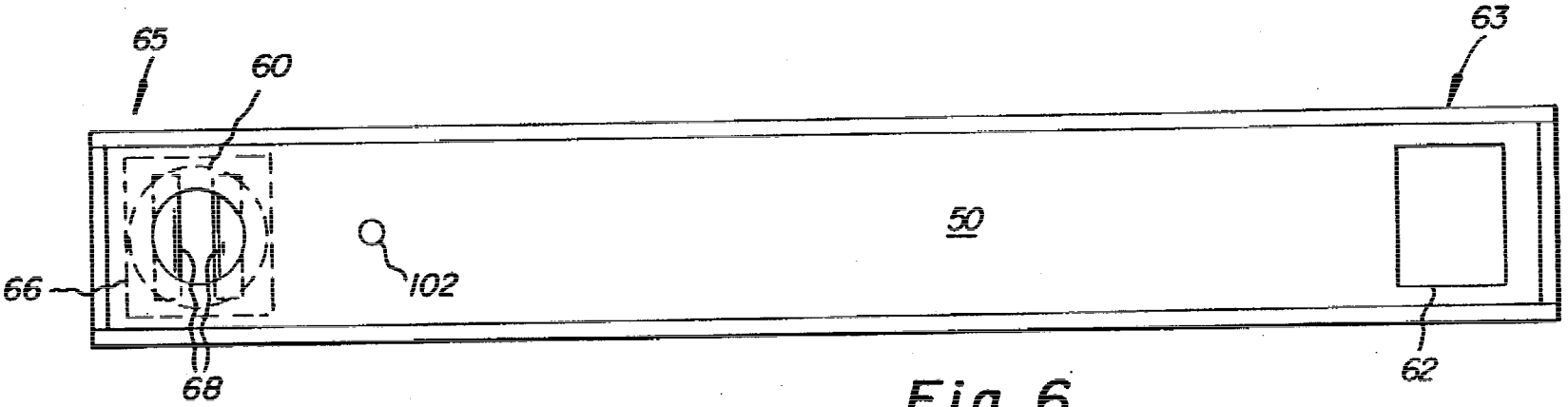
FIG. 6 is a top plan view of the lower body of the apparatus of FIG. 3. The locations of the secondary heater and fan are indicated by dashed lines.
Figure 7:
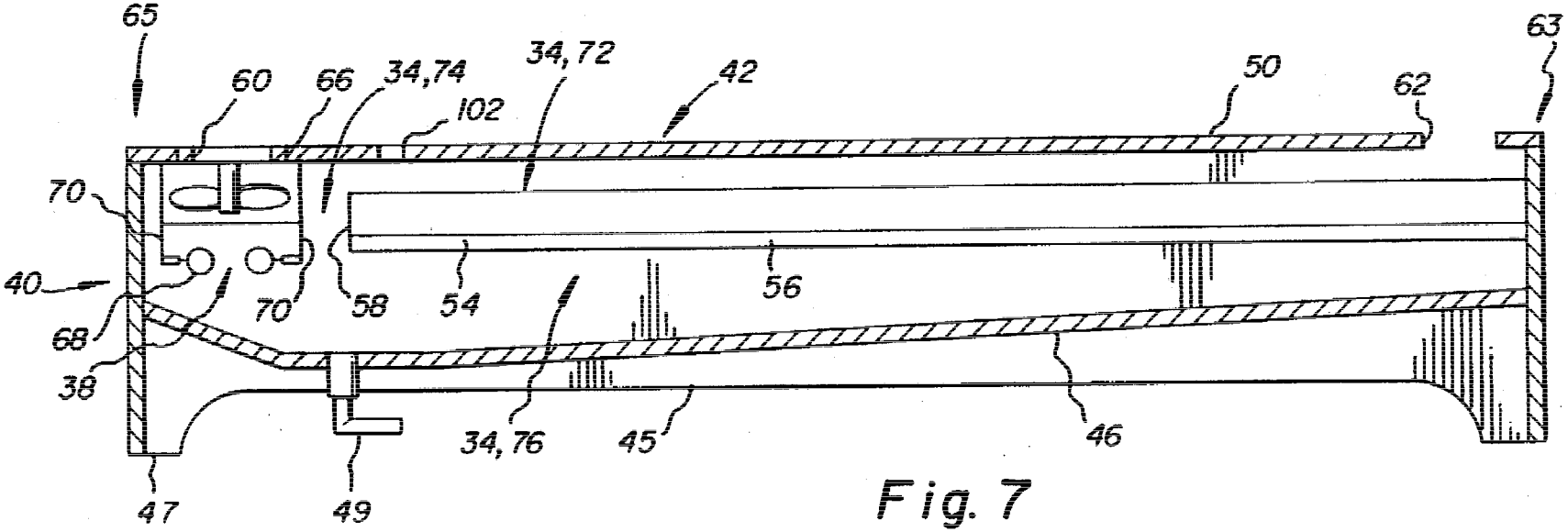
FIG. 7 is a longitudinal cross-sectional view of the lower body of FIG. 6.

Referring now to FIG. 1, a supply 10 of vaporizable material in liquid or solid form is maintained in a first or saturation zone 12, in thermal and phase equilibrium with an internal atmosphere, indicated by arrow 14, comprising a saturated vapor of the material at a first temperature, designated $T_1$ in FIG. 1. The material vapor in the first zone has the same temperature, $T_1$, as the liquid or solid material and a partial pressure, indicated as $P_1$ in FIG. 1. The term "partial pressure" is used to designate the vapor pressure of the vaporizable material independent of the presence or absence of another gas. A volume of the vapor is withdrawn, indicated by arrow 15 to a second zone or passageway 16 and is heated to a second temperature, $T_2$. The partial pressure of the material vapor remains substantially at $P_1$. The volume of vapor is then delivered, indicated by arrow 17 to a third zone or deposition zone 18. A substrate 20 is transported through the third zone 18. At entry into the deposition zone, indicated by the designation 20*a*, the substrate has a temperature, $T_3$, that is less than temperature $T_1$.

While the substrate 20 is transported through the deposition zone 18, (the direction of travel is indicated by arrow 21) a portion of the volume of material vapor is condensed onto the substrate 20, and the substrate 20 is heated. A large fraction of the rise in temperature of the substrate is due to the latent heat of vaporization (heat capacity) of the material condensate. At least part of the material condensate bonds with at least part of the substrate. The term "bonding" here is used in its chemical sense. Bonding is inclusive of hydrogen bonding and, with appropriate substrate and condensate, higher energy bonding.

The material vapor in the deposition zone 18 is at a temperature, $T_4$, that is at least substantially equal to temperature, $T_2$, and a partial pressure, $P_2$, that is at least substantially equal to $P_1$. The substrate, at exit from the deposition zone, indicated by designation 20*b*, is at a temperature $T_5$. This temperature, $T_5$, is higher than $T_S$. It is highly preferred, that no matter what the nature of the substrate, such as a multiple-layered composite; the temperature during the deposition, $T_s$, be substantially the same throughout the full depth of the substrate at all points in the deposition zone. "Full depth of the substrate" refers to any structure that could provide a heat sink to overlying portions of the substrate. The condensate amount is very uniform. In currently preferred embodiments, for consistent deposition volumes from one piece or length of substrate to another (assuming the same dimensions, entry temperature, composition, and dwell time), $T_5$ should preferably reach a temperature substantially equal to $T_1$.

The remaining material vapor is preferably recycled, indicated by arrows 23,25, by means of a return 22. The material vapor in the return 22 is at a temperature, $T_6$, and a partial pressure, $P_3$. It is desirable that the method approach the conditions of a closed loop, that is, that an internal atmosphere be maintained in at least partial isolation from the ambient environment (symbolized by walls 24), except for losses of heat and mass that necessarily occur in the deposition zone 18. It is thus desirable that the partial pressure be maintained substantially constant in the saturation zone 12, passageway 16, and deposition zone 18; that is, that $P_2$ be at least substantially equal to $P_1$. It is likewise desirable that $T_6$ be at least substantially equal to $T_4$. It is expected that $T_6$ is less than $T_4$ and that $P_3$ is less than $P_2$; however, it is desirable that this difference be minimized such that the $T_6$ remains substantially the same as $T_4$ and $P_3$ remains substantially the same as $P_2$. The net effect of maintaining temperatures and partial pressures in these ranges is to reduce the cyclical variation in partial pressure and reduce temperature fluctuations in the different zones 12, 18.

Additional losses of heat and mass occur during transport of the substrate into and out of the deposition zone 18. These losses can be rendered insubstantial by minimizing the spatial and temporal extent of openings into and out of the deposition zone. More complete control can be provided by performing the method of the invention within an outer enclosure (not shown) that provides, in effect, an artificial ambient environment between the zones and the outside environment.

It is particularly desirable that the partial pressure and temperature remain substantially constant in the deposition zone, since variations in partial pressure and temperature will tend to result in variations in deposition of the volatizable material. It is desirable that condensation be limited to the area of the exposed surface of the substrate, since condensation in other areas, particularly parts of the deposition zone in spaced relation to the substrate, tend to cause partial pressure and temperature variations. Such non-substrate condensation can also cause dripping onto the surface of the substrate resulting in non-uniform condensate concentrations.

The deposition of condensate in the improved deposition method can be explained by the equation below. This equation is expressed for a unit area of substrate of uniform shape and composition transported through the deposition zone at a uniform velocity. Any reaction of the condensate and substrate is assumed here to be limited to hydrogen bonding or other reaction presenting a minimal barrier to reversal. The equation is expressed in terms of a unit area of substrate. A convenient unit area, used herein unless otherwise specifically indicated, is equal to the area of the deposition zone. The equation is a mathematical model, but is supported by empirical results using water and a sheet substate, and it is believed that the condensation of most materials will very closely or substantially follow the equation. The scope of the invention is, however, not limited by any explanation or theory except as specifically claimed. The equation states:

$$Mc_p(T_5 - T_3) = \int_{t_{entry}}^{t_{exit}} h(T_4 - T_s(t))dt + \Delta H \int_{t_{entry}}^{t_{exit}} k(P_2 - P(T_s(t)))dt$$

M is the mass of a unit area of the substrate. $c_p$ is the specific heat of the substrate material. $T_3$, $T_4$, $T_5$, and $P_2$ have the same meanings as discusssed above in relation to FIG. 1. $t_{entry}$ and $t_{exit}$ are times of entry and exit of the substrate from the deposition zone, respectively. h is the heat transfer coefficient for the system conditions. $T_s(t)$ is the temperature of the substrate at a time, t, in the deposition zone. $\Delta H$ is the heat of vaporization of the vaporizable material. k is the mass transfer coefficient for the system conditions. $P(T_s(t))$ is the partial pressure of the vaporizable material at the temperature $T_s(t)$ at a time, t, in the deposition zone. The equation can be utilized for specific applications by computer approximation, taking into account any variations with temperature in parameters such as specific heat of the substrate material. Heat and mass transfer coefficients are available for a wide variety of system conditions, for example, laminar flow over a flat plate, and otherwise can be derived by well-known methods. Gas velocity, gas density, gas viscosity, geometry and the like are included in a determination of the system conditions.

Figure 10:
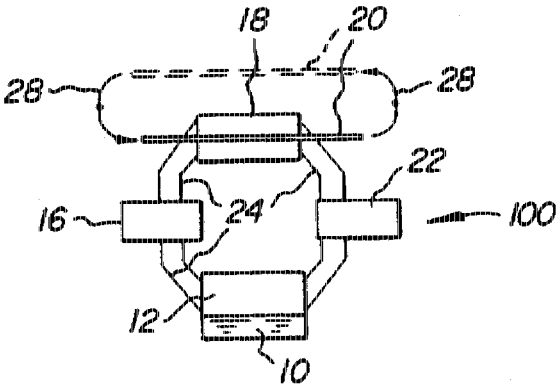
FIG. 10 is a diagrammatical view of another embodiment of the improved deposition method.
Figure 11:
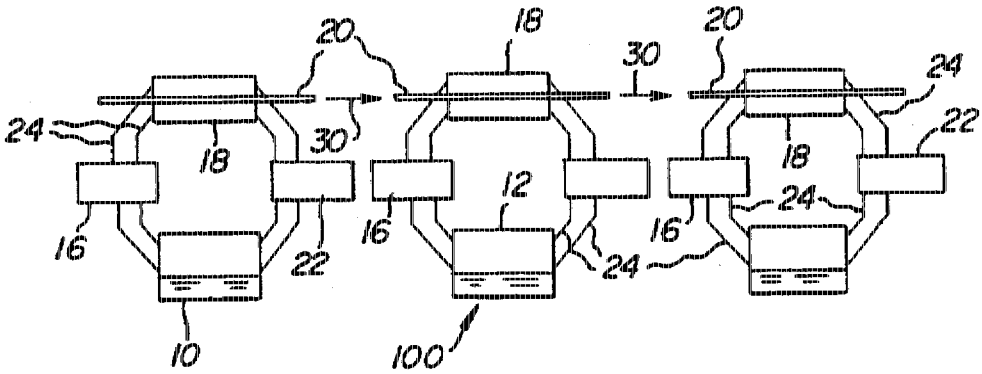
FIG. 11 is a diagrammatical view of still another embodiment of the improved deposition method.

Referring again to FIG. 1, the substrate can enter a secondary conditioning zone, indicated in FIG. 1 by arrow 26, after leaving the deposition zone 18. This zone 26 can be utilized to produce a secondary effect on the substrate 20, such as revaporizing the free (non-bonded) condensate from the surface of the substrate, or inducing a further chemical reaction between the substrate and condensate by adding heat or UV radiation or another reactant. The substrate can, similarly, be preconditioned in a preliminary conditioning zone, indicated by arrow 27, prior to entry into the deposition zone 18. For example, the temperature of the substrate 20 can be adjusted, upward or downward, to provide a desired initial substrate temperature. The improved deposition method can be repeated multiple times on all or a part of a substrate. FIG. 10 illustrates repeated passes (indicated by arrows 28) of a substrate 20 (indicated by solid and dashed lines) through the same deposition zone 18 of a single apparatus 100 like that of FIG. 1. FIG. 11 illustrates passing the substrate 20 sequentially (indicated by arrows 30 and solid and dashed lines) through the deposition zones 18 of a series of deposition apparatus 100.

The improved deposition method is not limited to substrates of a particular shape; however, as a practical mater it is easier to minimize leakage of the internal atmosphere if the substrate has a substantially uniform transverse cross-section. The substrate can be provided in discrete pieces or as a continuous web, or filament or the like. If discrete pieces are used, provision must be made to limit gross leakage when no substrate is present. In either case, adequate heat and vaporized material must be provided to accommodate the heat and mass transfer to the substrate with minimal change in temperature and partial pressure in the deposition zone.

The improved water deposition method differs from the more generalized improved depostion method just described, in an accomodation for the very large heat capacity of water. The generalized deposition method is described above, in terms of the partial pressure of the vaporizable material within the various zones. The deposition methods can be performed in an atmosphere including a gas (a material that remains in gas phase in all zones) or a gas mixture, such as air; or in the absence of other gases. With vaporizable materials having moderate heat capacities, the presence of a non-reactive gas or gas mixture can add a measure of convenience; but this effect is not particularly important. With water, the gas or gas mixture adds a buffering capacity that helps ensure a more uniform temperature distribution in the deposition zone and thus more uniform condensation on the substrate. The improved water deposition method otherwise tracks the features of the generalized deposition method above-described.

The non-reactive gas does not, directly or indirectly, participate in a reaction with the substrate. The methods of the invention can be performed in the presence of a "reactive" gas, a gas that reacts with the substrate, or condensate, or a product (final or intermediate) of the substrate and condensate. For example, the condensate could solvate a salt, and ions of the salt could then react with the reactive gas.

The following discussion of the deposition apparatus of the invention is primarily directed to a water deposition apparatus; however it will be apparent to those of skill in the art that a generalized deposition apparatus has common features differing substantially only in temperature settings and the like previously discussed in relation to the methods of the invention.

Referring now particularly to FIGS. 2–8, the improved deposition apparatus 100 of the application has a housing 32 that defines an interior atmosphere and separates that atmosphere, in at least partial isolation from the ambient environment. The housing 32 includes a saturation or moisture saturation portion 34, a deposition portion or chamber 36, and a passageway or conduit 38. Each of these elements, 32, 34, 36, 38, is defined by physical structure with boundaries determined by the limits of the physical structure. Similar terminology: saturation zone 12, deposition zone 18, and passage 16 is used herein to describe portions of the deposition apparatus 100 within which particular steps of the methods of the application occur. In some currently preferred embodiments of the invention, the limits of the zones: 12, 16, and 18; correspond to the physical limits of the similarly named elements: 34, 38, and 36. This is not necessarily the case in all embodiments of the invention. For example, in some embodiments of the invention, the deposition chamber 36 is longer (in the direction of substrate travel) than the deposition zone 18. The remaining section of the deposition chamber 36, in that embodiment, is part of a drying zone 26 (described in detail below.) As a matter of convenience, the description herein will generally refer to embodiments of the invention in which the limits of the moisture saturation chamber 34, deposition chamber 36, and passageway 38 substantially correspond with the limits of the moisture saturation zone 12, deposition zone 18, and passage 16, unless otherwise indicated.

One particular embodiment of the deposition apparatus 100 is shown in FIGS. 2–8. The apparatus 100 has a housing 32. The housing 32 has a lower body 40, an intermediate member 42, and an upper body 44. The lower body 40 is roughly trough shaped and has a bottom 46 separated from an underlying support surface (not shown) to limit heat transfer. In the embodiment shown, the bottom 46 is raised above an underlying support surface (not shown) by a pediment 45 defining legs 47 and an air gap 48. The bottom 46 is preferably sloped toward a drain 49.

The intermediate member 42 has a shelf 50 that rests on the upper margin of the lower body 40 and a pair of depending flanges 52 that extend into the lower body 40. A tray or pan 54 is suspended from the flanges 52. A primary heater or primary heating element 56 is located within the tray 54. A water inlet (not shown) extends into the housing 32 through the intermediate member 42 or lower body 40 to deliver water to the tray 54. The tray 54 can include a weir 58 disposed to deliver excess water from the tray 54 to the bottom 46 of the lower body 40 and the drain 49. The water reservoir 57 (shown schematically in FIG. 8) of the deposition apparatus 100 can be limited to the tray 54. Alternatively, water can continuously be admitted through the water inlet such that excess cascades over the weir 58 to the bottom 46 of the lower body 40. In that case, the water reservoir 57 includes the tray 54 and the lower body 40 to the extent that water accumulates on the bottom 46 prior to draining. The capacity of the water reservoir 57 is increased and includes water falling in the cascade from tray 54 to bottom 46. This embodiment has the additional advantage that formation of mineral deposits and growth of microorganisms can be deterred by the continuous flow of water.

The shelf 50 of the intermediate member 42 has openings 60,62 at opposite ends 63,65. At the first end 63, the tray 54 is disposed below the opening 62. At the second end 65, a fan 66 is suspended from the shelf 50 and a secondary heater or heating element 68 is suspended from a pair of baffles 70 that extend downward from the fan 66.

The tray 54, flanges 52, shelf 50, baffles 70, and sidewalls 71 and bottom 46 of the lower body 40 together delineate the moisture saturation chamber 34. The tray 54, shelf 50, and flanges 52 define a first air space 72 overlying the tray 54. The first air space 72 is closed at the first end 63 of the lower body 40 except for opening 62. The tray 54 and flanges 52 terminate short of the second end 65 of the lower body 40 and short of a first baffle 70. A second air space 74 is defined between the first baffle 70 and the tray 54 and flanges 52. The second air space 74 communicates with the first air space 72 at one end and then extends downward to a third airspace 76 defined by the lower side of the tray 54 and flanges 52, and the bottom 46 and sidewalls 71 of the lower body 40. The third air space 76 is blind at the first end 63 of the lower body 40. At the second end 65, the baffles 70 and sidewalls 71 define the passageway 38 extending outward from the moisture saturation chamber 34.

In the embodiment of the deposition apparatus 100 shown in the figures, the secondary heater 68 is illustrated as being disposed at the lower end of the passageway 38. The secondary heater 68 can be disposed at other points in the passageway 38; however, it is highly preferred that the secondary heater 68 be disposed in such a way that adequate mixing of the heated air is assured. This can most readily be provided, as shown in the figures, by disposing the secondary heater 68 immediately upstream from the fan 66. In the embodiment of the invention shown in the figures, the passageway 38 is very short relative to other dimensions of the deposition apparatus 100. The passageway 38 can be longer; however, a relatively shorter passageway 38 reduces energy requirements by providing a relative reduction in the interior volume of the deposition apparatus.

The conditioning or deposition chamber or upper body 36 is retained on the shelf 42. The upper body 36 has a pair of roughly U-shaped subunits 78,80. The first and second subunits 78,80 are joined together, open end to open end. At the ends 63, 65, the subunits 78,80 are each closed by a cap 79. In the mid-section of the subunits 78,80, the edges are recessed, defining front and rear substrate gaps 82 between the subunits 78,80. The remaining margins are joined together in preferably air-tight relation (not shown). The substrate path (indicated by dashed lines 84 in FIG. 8) extends across the chamber between the substrate gaps 82. The subunits 78,80 each have a subunit inner walls **86*a*,86*b*, which together define the plenum wall 86. The lower subunit 86*b* has openings 85,87 aligned with the openings in the intermediate member 42, which allow for the air flow path indicated by arrows 91**.

The subunit inner walls **86*a*,86*b* are made of a highly heat conductive material such as aluminum. A third heater 88 is disposed in heat conductive contact with the inner walls 86*a*,86*b*. If the inner walls 86*a*,86*b* have a large area in contact that provides good heat conduction, then the third heater 88 can have a single part (not shown) in contact with only one inner wall. Otherwise, the third heater 88 can have two subparts 88*a*,88*b*, one in contact with each inner wall 86*a*,86*b*(shown in FIG. 8 as circular units disposed in metal blocks abutting respective inner walls 86*a*,86*b***).

Each subunit **86*a*,86*b* has an outer wall 90*a*,90*b* (shown in FIG. 8, deleted for clarity in FIGS. 2–7) covering the respective inner wall 86*a*, 86*b*. The outer walls 90*a*,90*b* are composed of a highly insulative material such as polyethylene foam and have a sufficient thickness to substantially prevent heat losses from the plenum wall 86** through the outer wall.

Figure 8:
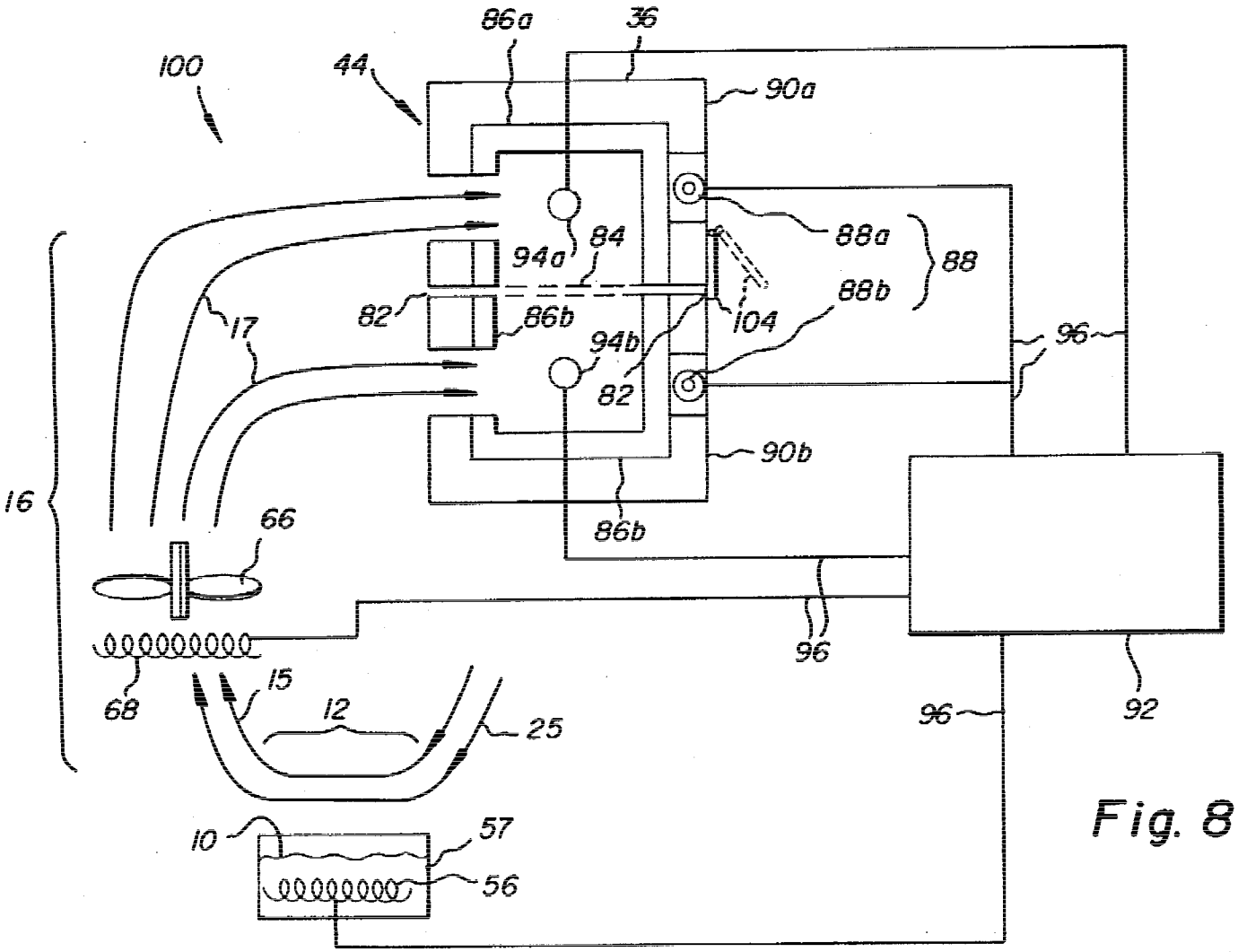
FIG. 8 is a diagrammatical view of the operation of the apparatus of FIG. 3.

Referring now particularly to FIGS. 8 and 1, a controller 92 is operatively connected to the heaters, primary 56 and secondary 68, or preferably, primary 56, secondary 68, and wall heater 88. The controller 92 includes a sensing portion 94 that senses wet and dry bulb temperatures of the internal atmosphere within the chamber 36. The sensing portion 94 can have a variety of forms. In the embodiment of the invention shown in the figures, the sensing portion includes two thermostat elements **94*a*,94*b* disposed in the conditioning chamber 36 and necessary signal and power connections 96 to the controller 92 and heaters 56,68,88. One of the thermostat elements is bare and provides what is referred to herein as the "dry bulb temperature". The other element is covered by a wick 98 which extends through a hole 102 in the intermediate member 42 to the tray 54** and provides what is referred to herein as the "wet bulb temperature". The wall heater can be operated on the basis of the dry bulb temperature in the deposition zone or one or more additional thermostat elements can be used to provide plenum wall or wall subunit temperatures.

The controller 92 can be limited to thermostats and necessary connections to the heaters, but this is not preferred since a relatively large temperature span must be provided between dry and wet bulb temperatures to prevent uncontrolled cycling. In addition, there is a tendency during warming up of the device to deposit liquid within the deposition chamber on the plenum wall. The controller preferably incorporates a computerized control that permits very small temperature adjustments of a degree Fahrenheit or less. The controller 92 can have separate humidity and and temperature sensors providing humidity and temperature information rather than wet and dry bulb sensors. In either event, the sensor input can be used by an appropriately programmed microprocessor, microcomputer, or the like. The computer programming used can be simple. As indicated in FIG. 1, it is preferred that the controller actuate the respective heaters when the sensing portion indicates that a dry bulb temperature, or wet bulb temperature or other function of temperature and pressure, is below a respective predetermined limit temperature and keep the respective heater actuated until the limit temperature has been reached. The same approach applies for the wall heater. The computer programming can be made more elaborate to provide accelerated warm-up prior to use, tracking of vaporizable material levels and other parameters, overheating protection, and other features.

As noted above, the method and apparatus of the invention can be used to condition discrete lengths of substrate, supplied either intermittently or continuously or can condition a substrate having the form of a continuous web or filament. The substrate is not limited to substantially one dimensional or two dimensional shapes, however, other shapes may present significant limitations. For example, the substrate can be the outside of a hollow tube of constant round or square cross-section. The invention can be directed to the conditioning of material or articles which are not themselves self-supporting or to small articles held by a larger carrier. In either case, for the purposes of the apparatus and method of the invention, the carrier and what is carded, together act as the substrate, at least for the purposes of condensation.

The substrate may be smaller than the substrate path; however, this will tend to allow a greater ingress of ambient air into the apparatus at the substrate gaps. The excessively large substrate path and greater air ingress can be accomodated, but at increased cost due to greater energy usage and at an increased risk of system failure due to nonuniform air admission and resulting nonuniform deposition. A better approach is to block unneeded portions of each substrate gap so as to define smaller gaps, that more closely match the substrate dimensions. Blocking can be provided intermittently. For example, flexible or deflectable skirts or curtains (illustrated diagrammatically in FIG. 8, in solid and dashed lines, as a hinged member 104) can overhang one or both gaps 82 to block ingress of ambient air when no substrate is being transported. The curtains can be divided into independently movable sections to accomodate different substrates of varying size. The curtains can similarly flex to accomodate moderate substrate size differences. Although curtains can be made to simultaneously accomodate major size differences in two orthogonal directions, it is preferred that substrate size variation, and curtain accomodations, be limited or substantially limited to a single dimension (for example, sheets of variable width, but substantially constant thickness).

Figure 9:
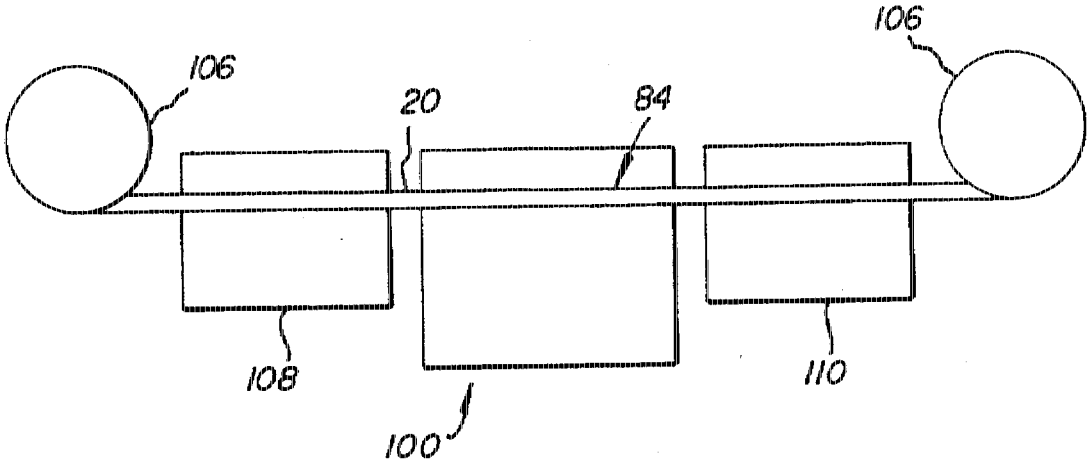
FIG. 9 is a semi-diagrammatical view of another embodiment of the improved deposition apparatus.

Referring now to FIG. 9, in an embodiment of the deposition apparatus 100, the substrate 20 is continuous and the apparatus includes a drive 106. A variety of drives can be used to transport the substrate; however, in most uses, it is highly preferred that the drive be capable of providing a substantially uniform rate of substrate transport. The drive can be as simple as powered feed-in and take-out roller pairs positioned just outside the substrate gaps. The apparatus of FIG. 9 also includes a preconditioner 108 and a secondary conditioner 110 appropriately positioned at opposite ends of the substrate path 84. Play-out and take-out mechanisms 106 are positioned beyond the preconditioner 108 and secondary conditioner 110 to provide transport.

The vaporizable material can be selected from a wide variety of materials, subject to practical limitations. One such major limitation is imposed by the temperatures necessary to perform the deposition method at an acceptable rate using a particular vaporizable material and the reactivities and other properties of that vaporizable material, relative to the substrate, apparatus housing, and any other materials present. For example, a wide variety of organic liquids are useful as vaporizable materials; but it is undesirable to use many of these materials unless the vaporized organic material can be isolated from oxygen. Similarly, materials that are difficult to vaporize due to degradation or the like are generally undesirable for use as the vaporizable material. Selection of suitable substrates, vaporizable materials, and conditions is straight-forward and can be a matter of trial and error, taking into account relevant chemical and physical properties.

The amount of material condensed is a function of the vaporizable material's latent heat of vaporization (generally it is much lower for organic materials compared to water). The amount of vaporizable material condensed is also a function of the vaporizable material's partial pressure in the atmosphere, the temperature of the deposition chamber atmosphere, the temperature of the substrate, and the residence time in the chamber. After determining whether a vaporizable material is desirable to use, it is a matter of matching the desired condensate amount to the physical properties of the vaporizable material and the operating parameters of a particular embodiment of the apparatus.

The volatizable material used in the methods and apparatus of the invention is not limited to a single compound. The volatizable material can be a mixture of different substances. It is an advantage of the invention that a minute volume of condensate can be layered onto a substrate. The volatizable material includes one or more "active" substances that condense onto the substrate resulting in a beneficial effect. In many currently preferred embodiments of the invention, the beneficial effect is a substrate product that has been physically or chemically modified. The improved methods and apparatus are not, however, limited to these beneficial effects, but can includes others such as preparation of condensates useful independent of the substrate. For example, condensate could be layered to produce a free-standing film removable from the substrate.

The volatizable material can also include one or more "inactive" substances that condense or partially condense onto the substrate, but do not themselves produce, or are unnecessary to produce, a particular beneficial effect. For example, a volatizable material including an alcohol and water could be condensed onto a substrate which covalently bonds with the alcohol. The water, in this example, would be considered inactive if it condensed on and later evaporated off the substrate without producing any noticeable physical or chemical change in the substrate.

The improved deposition method can be used to purify the vaporizable material. For example, a polymerization inhibitor in a material such as styrene that is removable by distillation, is removed during the improved deposition method. After deposition, the styrene can polymerize.

A chemically "active" deposition can be utilized, for example, to cross-link a polymer film on a support. A more specific example of this is the hardening of a photographic emulsion. In this case the substrate is the unhardened photographic emulsion and the vaporizable material is a mixture of formaldehyde (hardener) in water. Temperatures and dwell times can be derived by a process of elimination, taking into account the characteristics of the deposition apparatus. Similarly, a flux material can be deposited onto a substrate prior to welding or the like. High strength composite structures, such as vehicle bodies and the like, are commonly produced by winding adhesive coated ribbons or fibers. An activator, such as a low molecular weight volatile cross-linking agent, can be vapor deposited immediately prior to winding.

In the use of the improved deposition method with photographic film as the substrate and water as the condensate, it has been surprisingly determined that the surface of a photographic emulsion layer can be reformed by the substantially uniform deposit of a very small amount of water on the photographic emulsion layer.

The term "photographic emulsion layer" is used herein to describe one or more layers of a photographic film which include silver halide or other photo-reactive agent or agents for latent image capture; and hydrophilic materials as vehicles and vehicle extenders. The vehicles and vehicle extenders are generally water-permeable colloids that form lattices or other extended molecular structures when hydrated. Suitable materials include naturally occurring substances and derivatives of such materials. Examples of materials are proteins and polysaccharides, and their derivatives. More specific examples are: gelatins such as alkali-treated gelatins (cattle bone or hide gelatin) and acid-treated gelatin (pigskin gelatin), gelatin derivatives such as acetylated gelatin, and phthalated gelatin, cellulose, cellulose esters, dextran, gum arabic, zein, casein, pectin, collagen derivatives, collodion, agar—agar, arrowroot, albumin, and mixtures of such materials. Photographic emulsion layers can also include synthetic peptizers, carriers, and/or binders as vehicles or vehicle extenders, alone or in combination with naturally-occurring or derived materials. Examples of such materials include poly(vinyl lactams), acrylamide polymers, polyvinyl alcohol and its derivatives, polyvinyl acetals, polymers of alkyl and sulfoalkyl acrylates and methacrylates, hydrolyzed polyyvinyl acetates, polyamides, polyvinyl pyridine, acrylic acid polymers, maleic anhydride copolymers, polyalkylene oxides, methacrylamide copolymers, polyvinyl oxazolidinones, maleic acid copolymers, vinylamine copolymers, methacrylic acid copolymers, acryloyloxyalkyl sulfonic acid copolymers, sulfoalkyl acrylamide copolymers, polyalkyleneimine copolymers, polyamines, N,N-dialkylaminoalkyl acrylates, vinyl imidazole copolymers, vinyl sulfide copolymers, halogenated styrene polymers, amineacrylamide polymers, polypeptides, compounds containing semicarbazone or alkoxy carbonyl hydrazone groups, polyester latex compositions, polystyryl amine polymers, vinyl benzoate polymers, carboxylic acid amide lattices, copolymers containing acrylamidophenol cross-linking sites, vinylpyrrolidone, and colloidal silica.

Photographic emulsion layers can contain a wide variety of other materials such as hardeners, sensitizers, desensitizers, brighteners, antifoggants and stabilizers, coating agents, plasticizers, lubricants, color materials, and light absorbing and scattering agents. Photographic emulsions can be provided as single layers on a support, or more commonly as multiple layers along with layers providing specialized functions such as aft-cud, anti-static, abrasion resistance and the like. Outer layers optionally provided over the photographic emulsion layer allow the passage of water for processing purposes.

The term "photographic emulsion layer" used herein is also inclusive of similarly constituted layers utilized for non-photographic purposes.

In the improved photographic emulsion surface reforming method, the emulsion layer is first dried to at least sensible dryness, that is a level of dryness undetectable by surface feel or directed, unaided visual inspection. This drying can be subsequent to the laydown of the emulsion layer in the manufacture of the photographic film, or alternatively, can be subsequent to processing of exposed film. Water is then deposited on the surface of the emulsion layer in an mount that is less than about 0.80 grams of water per square foot of emulsion layer. This amount is less than the amount of water that is deposited on the surface of the emulsion layer by dipping, followed by squeegeeing. Although it is highly preferred that the water be deposited in accordance with the improved water deposition method disclosed herein, alternative procedures could be used. For example, the emulsion layer could be rubbed past a moist blotter or water could be knife coated over the surface of the emulsion layer. Practical difficulties in such alternative water deposition procedures currently limit their desirability relative to the improved water deposition method disclosed herein. For example, small non-uniformities of pressure or surface shape tend to cause local deposition differences that result in visible streaks on the emulsion surface. The improved water deposition method, in contrast, is much less sensitive to such degradation factors.

It the preferred embodiment of the improved photographic emulsion surface reforming method a sheet or web bearing a photographic emulsion layer is treated as described above in relation to the improved deposition methods. The sheet or web is passed sequentially through deposition and redrying zones. In the deposition zone, the emulsion surface is contacted with water vapor at a preselected partial pressure (preselected as described herein or simply by trial and error) and at a temperature in excess of the dew point of water at the preselected partial pressure. During the contacting, the emulsion layer warms to a temperature at least substantially equal to the dew point and water condenses onto the emulsion layer surface. Condensed water bonds with one or more components of the emulsion layer. It is believed that the condensed water preferentially hydrogen bonds with the hydrophilic vehicle, however, other bonding may also occur. Unless the emulsion layer is much thinner than those in ordinary use in consumer or professional grades of commercial photographic film, the amount of water is insufficient to completely or even substantially swell the emulsion layer.

After the water has been deposited, the sheet or web is transported to a drying zone and any remaining free water is vaporized from the surface of the emulsion layer, simultaneously cooling the emulsion layer. (Waters of hydration of one or more compounds may remain bound depending upon materials used and specific conditions.)

The improved photographic emulsion surface reforming method is applicable to films having emulsion layers on one or both sides. With a single-sided film, water condensing on and drying from the support side effects the temperature of the film as a whole. A variety of materials can be used as photographic supports, but commonly used materials are "inert" to water and water vapor at temperatures suitable for the methods of the invention; that is, the supports may hydrate and then dehydrate slightly, but without any perceptible change in visual characteristics.

It is preferred that the water deposited in the improved photographic emulsion surface reforming method be in a substantially uniform volume of from about 0.10 grams of water per square foot of emulsion layer surface to about 0.40 grams of water per square foot of emulsion layer surface. A more preferred range is from about 0.10 to about 0.30 grams of water per square foot of emulsion layer surface. Still more preferred is a range of from about 0.10 to about 0.20 grams of water per square foot of emulsion layer surface. In these ranges of water deposition, the water on the emulsion surface revaporizes immediately after the completion of deposition and there is no need to wait for the emulsion surface to dry. With the improved water deposition method, the redrying time is less than the time needed to deposit the water on the emulsion. As a result, the second treatment or drying zone is very short and it is unnecessary to handle the sheet or web during redrying. Since the first treatment or deposition zone is also short it is easy to position sheet or web handling devices, such as pinch rollers, so as to contact the emulsion surface only before vapor deposition and after redrying. The surface of the emulsion layer is thus protected from physical contact while wet.

The following Examples and Comparative Examples are presented to further illustrate some preferred modes of practice of the improved methods and apparatus. Unless otherwise indicated, all starting materials were commercially obtained. Surface gloss was measured at a 20 degree incidence angle before and after vapor deposition. A mean level and a measure of variation were calculated. The visual appearance of surface gloss on some processed photographic films is desired to be low and uniform so as not to interfere with the transmission viewing of the image. Upon visual inspecion, the following subjective scale was used to quantify the degree of gloss improvement due to treatment of an extremely uneven gloss film:

Good gloss evenness: 75–100% gloss unevenness removed

Fair gloss evenness: 40–74% gloss unevenness removed

Poor gloss evenness: 0–39% gloss unevenness removed

COMPARATIVE EXAMPLE 1

A photographic film having a photographic emulsion layer 0.007 inch thick was subjected to photographic processing and was at a temperature of 155° F. for a time in excess of the minimum time necessary to produce sensible dryness. The resulting film (hereafter referred to as a "severely dried film") had poor gloss evenness with an extremely uneven surface gloss and generally high gloss on the dried emulsion layer.

COMPARATIVE EXAMPLE 2

A severely dried film prepared substantially as in Comparative Example 1 was dipped into water and allowed to dry under room conditions (70° F. ambient air). The film absorbed 1.96 grams of water per square foot of film surface. It took 13 minutes for the film to dry. The film was measured for gloss evenness and it was determined that the gloss evenness was upgraded to "good" by this treatment, but the film exhibited a "warmer" tone, a bronze hue, upon reflection.

EXAMPLE 1

A severely dried film prepared substantially as in Comparative Example 1 was subjected to the improved water deposition method using an apparatus substantially the same as that shown in the Figures. Water was placed in the tray, and the fan and controller were started. The deposition chamber containing water vapor and air was set at the conditions of 140° F. dry bulb temperature and 135° F. wet bulb temperature. The apparatus was allowed to warm up without a substrate. The severely dried film was then transported along the substrate path at 1.0 inch/second for a residence time in the deposition chamber of 1.5 seconds. The temperature of the severly dried film at entry into the deposition chamber was 70° F. Water was condensed onto the film in the deposition chamber. It was calculated that the amount of condensate was about 0.12 grams of water per square foot of film surface. Evaporation of the condensate was very rapid and upon exiting the chamber, the film appeared sensibly dry (dry to the touch). The film was measured for gloss evenness before and after treatment in the chamber. It was determined that 86 per cent of the gloss unevenness was removed by this treatment giving the film a good appearance for its intended purpose.

EXAMPLE 2

The procedures of Example 1 were repeated using another severely dried film prepared substantially as in Comparative Example 1, except the dry bulb temperature was 110° F. and the wet bulb temperature was 105° F. It was calculated that about 0.04 gram of water per square foot of film surface condensed onto the film. Upon exiting the chamber, the film appeared dry to the touch. The film was measured for gloss evenness before and after treatment in the chamber. It was determined that 26 per cent of the gloss unevenness was removed by this treatment leaving the film with still a poor appearance for its intended purpose.

HYPOTHETICAL EXAMPLE 1

The procedures of Example 1 would be substantially repeated, except a polyethylene terephthalate film of 0.007 inch thickness would be used as the substrate. Temperature of the substrated at entry into the deposition chamber would be 130° F. The deposition chamber would contain an internal atmosphere n-octane at 65 per cent relative "humidity" in air at 170° F. The film would be transported through the chamber at 0.3 inch/second with a residence time in the deposition chamber of 5 seconds. It was calculated that about 0.12 grams of n-octane per square foot of film surface would condense onto the film.

While specific embodiments of the invention have been shown and described herein for purposes of illustration, the protection afforded by any patent which may issue upon this application is not strictly limited to a disclosed embodiment; but rather extends to all modifications and arrangements which fall fairly within the scope of the claims which are appended hereto:

PARTS LIST supply 10
first or saturation zone 12
saturated vapor internal atmosphere 14
arrow 15
second zone or passageway 16
arrow 17
third zone or deposition zone 18
substrate 20
arrow 21
return 22
arrows 23
walls 24
arrow 25
secondary conditioning zone 26
preliminary conditioning zone 27
arrows 28
arrows 30
housing 32
saturation or moisture saturation portion 34
deposition portion or chamber (or upper body) 36
passageway or conduit 38
lower body 40
intermediate member 42
upper body 44
pediment 45
bottom 46
legs 47
air gap 48
drain 49
shelf 50
depending flanges 52
tray or pan 54
primary heater or primary heating element 56
water reservoir 57
weir 58
openings 60,62
ends 63,65
fan 66
secondary heater or heating element 68
baffles 70
sidewalls 71
first air space 72
second air space 74
third air space 76
first and second subunits 78,80
caps 79
front and rear substrate gaps 82
substrate path 84
opening 85
subunit inner walls **86*a*, 86*b***
plenum wall 86
opening 87
third heater 88, having two parts **88*a* and 88*b***
outer wall **90*a*,90*b***
air flow path arrows 91
controller 92
sensing portion 94
thermostat elements **94*a*,94*b***
signal and power connections 96
wick 98
apparatus 100
hole 102 skirts or curtains 104 drive 106 preconditioner 108 secondary conditioner 110

What is claimed is:

1. A method for reforming the surface of a photographic emulsion layer comprising the steps of:

drying the surface of said emulsion layer to a predetermined dryness;

depositing water onto said surface of said emulsion layer, said depositing being substantially uniform and in an amount that is less than about 0.80 grams of water per square foot of said emulsion layer.

2. The method of claim 1 wherein said depositing is in the amount of from about 0.10 grams of water per square foot of emulsion layer surface to about 0.40 grams of water per square foot of emulsion layer surface.

3. The method of claim 1 further comprising following said depositing, immediately redrying said surface.

4. The method of claim 3 further comprising protecting said surface from physical contact during said redrying.

5. The method of claim 3 further comprising protecting said surface from physical contact during said depositing and redrying.

6. The method of claim 1 further comprising contacting said substrate surface with water vapor at a preselected partial pressure and at a temperature in excess of the dew point of water at said preselected partial pressure, and during said contacting, warming said substrate to a temperature at least substantially equal to said dew point.

7. A method for reforming the surface of a photographic emulsion layer comprising the steps of:

condensing water onto the surface of said web, at a substantially uniform volume of from about 0.10 grams of water per square foot of surface to about 0.4 grams of water per square foot of surface;

allowing at least a portion of said condensed water to bond with said substrate; and vaporizing any remaining free water from said surface.

8. The method of claim 7 wherein said vaporizing step is substantially faster than said condensing step.

9. A method for conditioning a photographic substrate, comprising the steps of:

condensing water onto at least one surface of said substrate in a first treatment zone, said condensing being at a substantially uniform volume of from about 0.1 grams of water per square foot of surface to about 0.4 grams of water per square foot of surface;

allowing at least a portion of said condensed water to bond with said substrate;

vaporizing any remaining free water from said surface in a second treatment zone; and transporting said substrate sequentially through said zones.

10. The method of claim 9 wherein said water is condensed onto said surface of said substrate, at a substantially uniform volume of from about 0.1 grams of water per square foot of surface to about 0.3 grams of water per square foot of surface.

11. The method of claim 9 wherein said water is condensed onto said surface of said substrate, at a substantially uniform volume of from about 0.1 grams of water per square foot of surface to about 0.2 grams of water per square foot of surface.

12. The method of claim 9 further comprising cooling said substrate concurrently with said vaporizing.

* * * * *